US007481634B2

(12) United States Patent
Candio et al.

(10) Patent No.: US 7,481,634 B2
(45) Date of Patent: Jan. 27, 2009

(54) VOLUMETRIC SCREW COMPRESSOR PROVIDED WITH DELIVERY ADJUSTMENT DEVICE

(75) Inventors: Gianni Candio, Lonigo (IT); Enrico Faccio, Cologna Veneta (IT); Diego Portinari, Lonigo (IT)

(73) Assignee: Refcomp S.p.A., Lonigo (VI) (IT)

( * ) Notice: Subject to any disclaimer, the term of this patent is extended or adjusted under 35 U.S.C. 154(b) by 0 days.

(21) Appl. No.: 10/591,562

(22) PCT Filed: Mar. 2, 2005

(86) PCT No.: PCT/EP2005/050933

§ 371 (c)(1),
(2), (4) Date: Jul. 13, 2007

(87) PCT Pub. No.: WO2005/085644

PCT Pub. Date: Sep. 15, 2005

(65) Prior Publication Data

US 2007/0274852 A1 Nov. 29, 2007

(30) Foreign Application Priority Data

Mar. 3, 2004 (IT) ..... VI2004A0034

(51) Int. Cl.
*F03C 2/00* (2006.01)
*F04C 18/00* (2006.01)

(52) U.S. Cl. ..... 418/201.2; 418/84; 418/87; 418/201.1; 417/280; 417/310

(58) Field of Classification Search ..... 418/201.2, 418/201.1, 84, 87; 417/228, 280, 282, 310
See application file for complete search history.

(56) References Cited

U.S. PATENT DOCUMENTS 6,276,911 B1 8/2001 Krusche et al.

FOREIGN PATENT DOCUMENTS

| | | | | | |
|---|---|---|---|---|---|
| EP | 1072796 | A2 | | 1/2001 | |
| JP | 59211784 | | | 11/1984 | |
| JP | 60164693 | A | * | 8/1985 | ..... 418/201.2 |
| JP | 60216092 | A | * | 10/1985 | ..... 418/84 |
| JP | 63106391 | A | * | 5/1988 | ..... 418/201.2 |
| JP | 06173872 | | | 6/1994 | |
| JP | 07259778 | | | 10/1995 | |
| JP | 10089271 | A | * | 4/1998 | |
| JP | 11013675 | | | 1/1999 | |
| JP | 11082354 | A | * | 3/1999 | |

* cited by examiner

*Primary Examiner*—Theresa Trieu
(74) *Attorney, Agent, or Firm*—IP Strategies

(57) ABSTRACT

A volumetric compressor comprising: a casing provided with a suction chamber and a delivery chamber, between which a pair of screw rotors is included; a pan containing oil, and a delivery adjustment unit equipped with a slide valve, cooperating with the rotors and with a fluid-operated actuator, in which it is possible to identify an active chamber with a sliding piston connected to the slide valve. The adjustment unit comprises a flow switching unit, that connects the active chamber of the actuator to the pan and to the suction chamber and comprises a static flow switch removably associated with a switching solenoid valve electrically connected to a control unit. The switching solenoid valve is suited to be associated, alternatively, with different static flow switches that make it possible to obtain deliveries of compressed fluid varying discretely or continuously, depending on the position of the slide valve with respect to the rotors.

20 Claims, 9 Drawing Sheets

VOLUMETRIC SCREW COMPRESSOR PROVIDED WITH DELIVERY ADJUSTMENT DEVICE

BACKGROUND OF THE INVENTION

The invention concerns a volumetric compressor provided with a delivery adjustment device and in particular a screw compressor comprising a casing in which it is possible to identify a suction chamber equipped with a suction valve and a delivery chamber equipped with a delivery valve, between which a pair of screw rotors meshing with each other is included. At the bottom of the casing there is a pan for the lubrication oil.

It is known that the volumetric screw compressors described above are equipped with a delivery adjustment unit comprising a slide valve that cooperates externally with the rotors and is set in motion by a fluid-operated actuator according to a longitudinal direction parallel to the longitudinal axis of the rotors themselves.

The fluid-operated actuator is provided with an active chamber fed with the oil coming from the pan in order to obtain the sliding movement of a piston positioned in the active chamber and provided with a rod that connects it to the slide valve.

On the liner and on the bottom of the actuator there is a plurality of flow paths connected to the same number of drain pipes conveying the oil from the active chamber of the actuator to the suction chamber of the compressor.

In particular, each drain pipe is equipped with an on-off valve and the paths for communication with the active chamber, to which the pipes are connected, are arranged as follows: one on the bottom and the others, positioned on the liner, aligned parallel to the piston sliding direction and having different axial distances with respect to the bottom.

In this way, by selectively opening and closing the valves, it is possible to maintain different quantities of oil in the active chamber of the actuator, in such a way as to arrange the piston, and therefore the slide valve connected to it, in different axial positions with respect to the rotors.

In this way, the compressor's suction is controlled and the delivery of the same is modified.

According to the above, it is obvious that the degree of control of the compressor's delivery depends on the position of the flow paths of the actuator and on what on-off valves are opened and what remain closed.

A volumetric screw compressor of the type mentioned above is described in the European Patent application EP 1 072 796 in the name of Bitzer Kühlmaschinenbau GmbH, according to which an electric/electronic control device, connected to the actuators of the on-off valves of the drain pipes, controls the opening and closing of the valves themselves in such a way as to control the delivery of the compressor, according to the user's needs.

The above mentioned control device manages the opening and closing of the above mentioned valves according to different modes, in such a way as to control the compressor's delivery in steps or continuously.

The volumetric compressor described in the patent application mentioned above has some recognized drawbacks.

A first recognized drawback is constituted by the fact that the on-off valves are controlled electrically and, to adjust the delivery, a suitable control device acts on the solenoids that control more than one valve.

Therefore, in case of failure of the control device, the operation of the adjustment unit is stopped completely.

Another recognized drawback is constituted by the long time required for the repairs in case of failure of the control device.

The present invention aims to overcome the drawbacks listed above.

BRIEF SUMMARY OF THE INVENTION

In particular, it is a first aim of the invention to carry out a volumetric screw compressor provided with a delivery adjustment unit that, compared to the known adjustment units having the same adjusting capacity, contains fewer electric components.

It is another aim that the compressor of the invention should be provided with a delivery adjustment unit that makes it possible to choose between two different delivery adjustment systems, separate and independent of each other, one with discrete and the other with continuous delivery variation.

The aims mentioned above are achieved through the implementation of a volumetric screw compressor that, according to the main claim, comprises:

- a casing in which it is possible to identify a suction chamber and a delivery chamber, between which a pair of screw rotors is included;
- an oil pan;
- a delivery adjustment unit for said compressor, comprising:
- a slide valve externally cooperating with said rotors;
- a fluid-operated actuator constituted by a cylinder, in which it is possible to identify an active chamber with a sliding piston connected to said slide valve through a rod;
- a plurality of flow paths made in said cylinder in correspondence with said active chamber;
- at least one oil delivery duct connected to said pan;
- a plurality of oil drain ducts connecting said flow paths of said active chamber with said suction chamber;
- on-off solenoid valves inserted in said drain ducts;
- at least one control unit of said solenoid valves, and is characterized in that it comprises a flow switching unit, connecting said active chamber of said actuator with said pan and with said suction chamber, and comprises a flow switch removably associated with a switching solenoid valve electrically connected to said control unit, wherein said switching solenoid valve can be associated, alternatively, with flow switches, with separate fluid ducts, depending on the open or closed position of said solenoid valves and on the position of said slide valve with respect to said rotors, to obtain separate deliveries of compressed fluid.

Advantageously, the fact that the delivery adjustment unit is simpler to construct makes maintenance operations quicker and easier compared to the prior art.

The fact that repairs are easier to carry out in case of breakage is also advantageous.

BRIEF DESCRIPTION OF THE DRAWINGS

The aims and advantages mentioned above will be highlighted in greater detail in the description of some favorite embodiments of the invention, given as examples without limitation with reference to the enclosed drawings, in which:

FIG. 1*a* shows a detail of FIG. 1;

Figure 8:
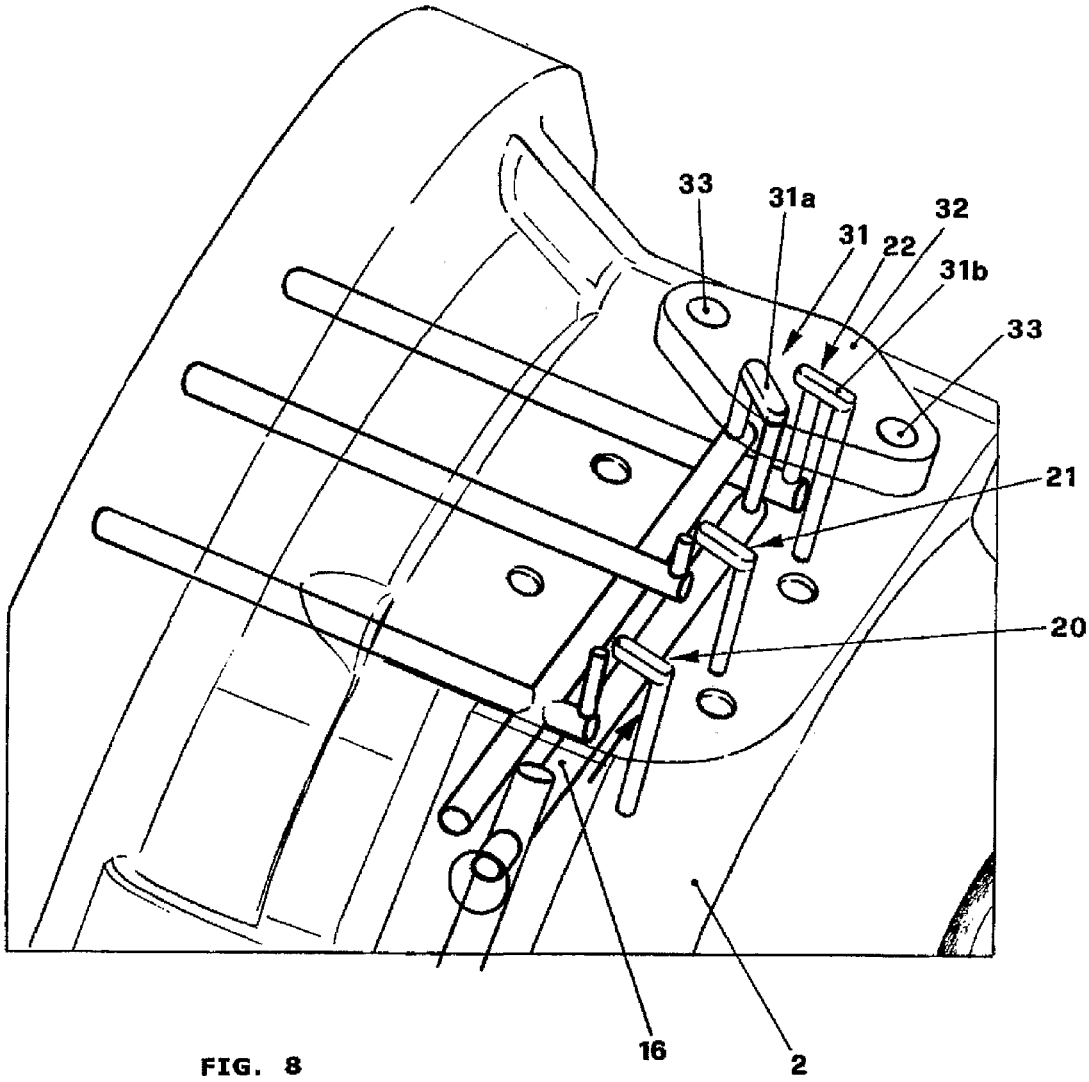
Figure 9:
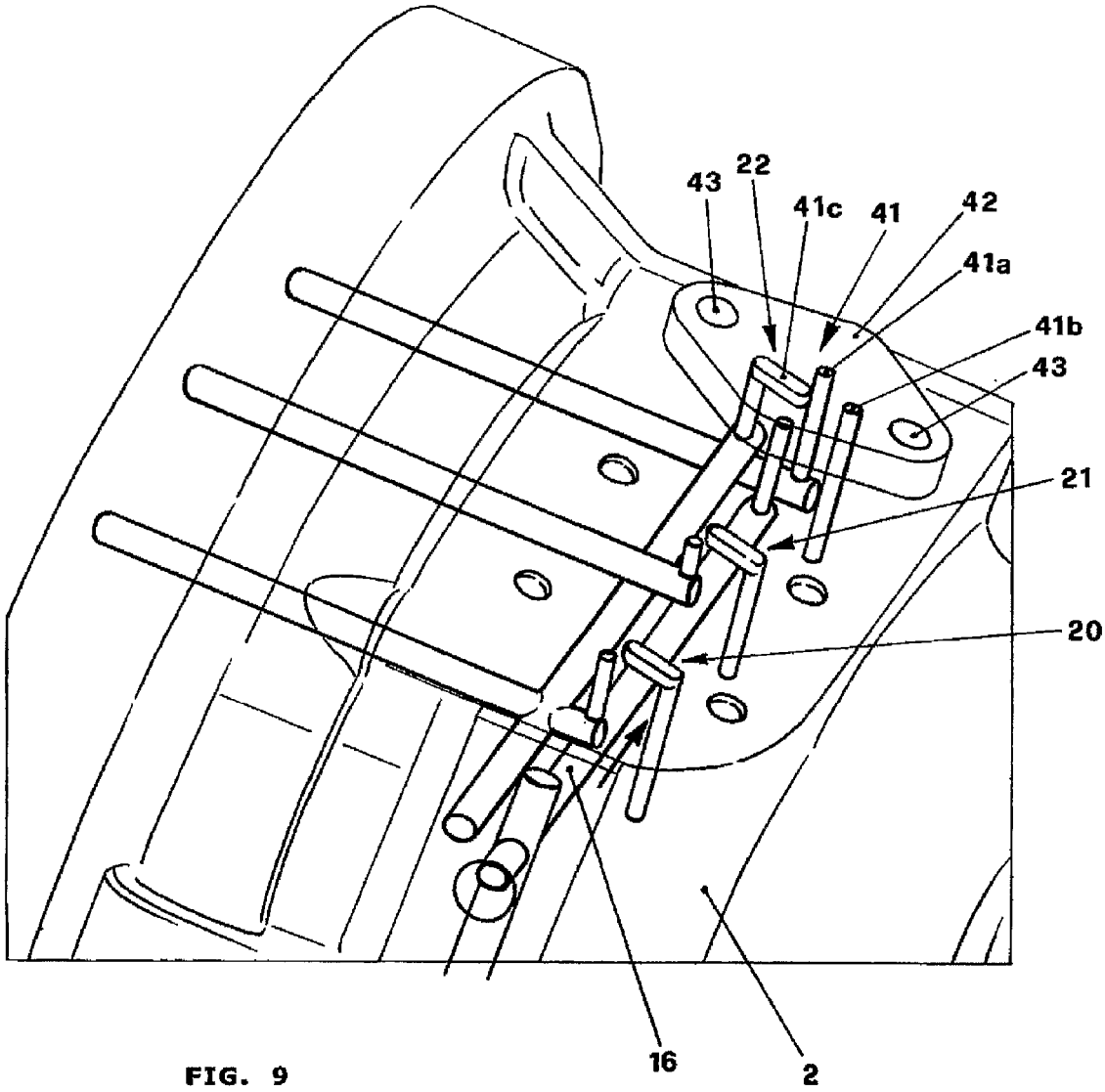

FIGS. from 2 to 7 show a longitudinal section of the compressor of the invention in different operating configurations;

FIGS. 8 and 9 are axonometric views of two of the different operating configurations of the compressor shown in the FIG*s*. from 1 to 7.

DETAILED DESCRIPTION OF THE INVENTION

Figure 1:
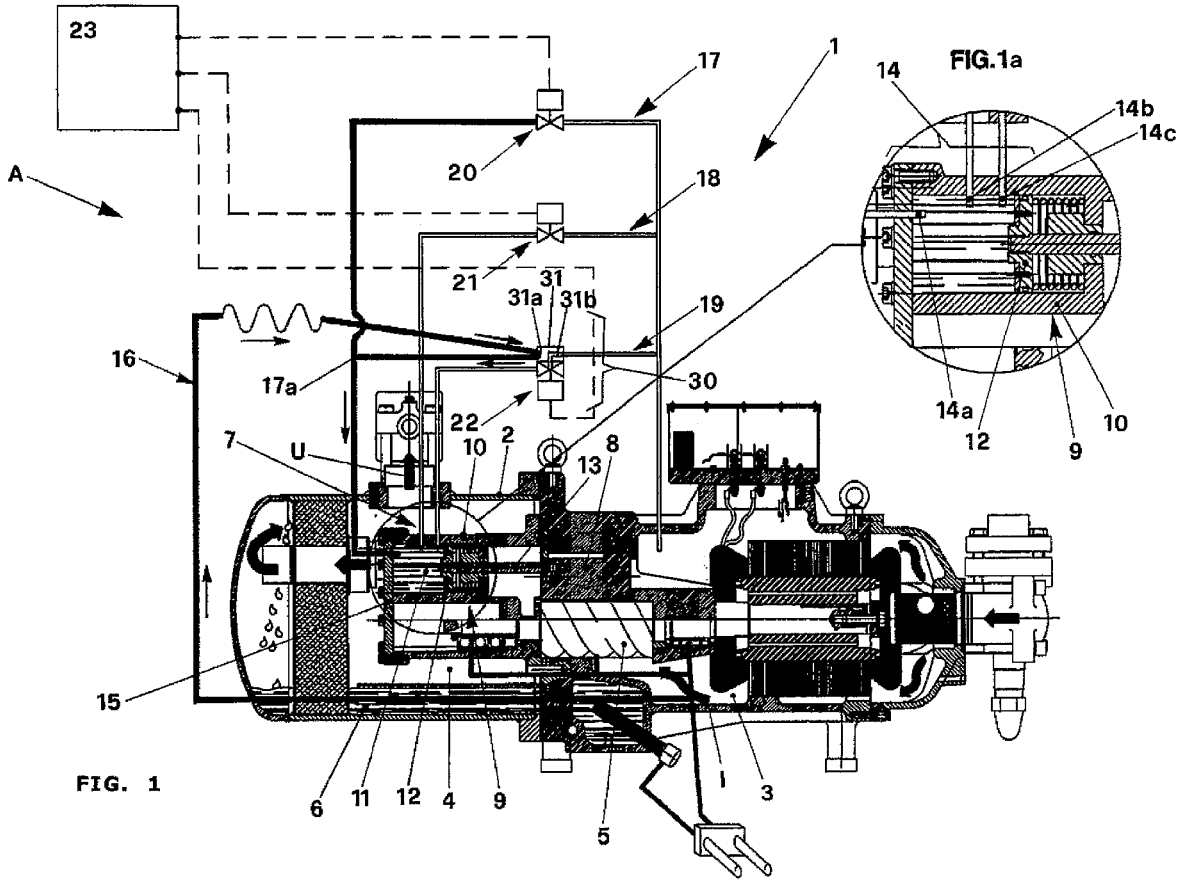
FIG. 1 shows a longitudinal section of the compressor of the invention.

The compressor of the invention is represented in longitudinal section in FIG. 1, where it is indicated as a whole by 1, and where it can be observed that it is of the volumetric type with screw and comprises a casing 2 in which it is possible to identify a suction chamber 3 and a delivery chamber 4, between which a pair of screw rotors is included, each rotor being indicated by 5 and only one of them being visible in the drawing.

In the lower part of the casing 2 there is a pan 6 suited to contain the lubrication oil.

In the casing 2 there is also a unit for the adjustment of the delivery of the compressor, indicated as a whole by 7, comprising:

- a slide valve 8 that cooperates externally with the rotors 5;
- a fluid-operated actuator, indicated as a whole by 9, constituted by a cylinder 10 in which it is possible to identify an active chamber 11 in which a piston 12 slides, which is connected to the slide valve 8 through a rod 13;
- a plurality of flow paths, indicated as a whole by 14, that can be observed also in the detail of FIG. 1*a*, which are made in the cylinder 10 in correspondence with the active chamber 11 and which are connected to a series of pipes through which the oil taken from the pan 6 is circulated, in order to define different operating configurations of the compressor that are described here below.

As first thing, it can be observed that the flow paths 14 comprise a first flow path 14*a* made in the bottom 15 of the cylinder 10 and a second and a third flow path, 14*b* and 14*c* respectively, that instead are both made in the liner of the cylinder 10.

Furthermore, it can be observed that the flow paths made in the liner are aligned, and in particular the second flow path 14*b* is in an intermediate position between the bottom 15 and the third flow path 14*c*.

As to the series of pipes mentioned above, comprising the unit 7 for adjusting the delivery of the compressor, it can be observed that they include an oil delivery duct 16 connected to the pan 6 and a plurality of oil drain ducts, indicated as a whole by 17, 18 and 19, connecting respectively the first flow path 14*a*, the second flow path 14*b* and the third flow path 14*c* of the cylinder 10 of the actuator 9 to the suction chamber 3.

In the drain ducts there are on-off solenoid valves, and precisely a first solenoid valve 20 arranged in the first drain duct 17 and a second solenoid valve 21 inserted in the second drain duct 18.

The solenoid valves are electrically connected to a control unit 23 provided with means suitable for opening/closing the solenoid valves themselves.

According to the invention, the adjustment unit 7 comprises also a flow switching unit 30, 40 that connects the active chamber 11 of the actuator 9 to the pan 6 and to the suction chamber 3 and comprises a flow switch removably associated with a switching solenoid valve 22 electrically connected to the control unit 23, the switching solenoid valve 22 being suited to be associated, alternatively, with flow switches 31, 41, different from each other, that make it possible to obtain deliveries of compressed fluid varying discretely or continuously, depending on the open or closed position of said solenoid valves 20, 21, 22 and on the consequent position of the slide valve 8 with respect to the rotors 5.

According to a first embodiment of the invention that can be observed in FIG. 1, the flow switching unit 30 comprises the switching solenoid valve 22 associated with the first flow switch 31, in which it is possible to identify:

- a first flow duct 31*a* connecting the delivery duct 16 to the first drain duct 17 in an intermediate position 17*a* between said first on-off solenoid valve 20 and said cylinder 10;
- a second flow duct 31*b* positioned in series with respect to the switching solenoid valve 22 and both inserted in the third drain duct 19 connecting the third flow path 14*c* of the active chamber 11 to the suction chamber 3.

This first executive embodiment makes it possible to obtain compressed fluid delivery values that vary discretely depending on the opening and closing positions of the on-off valves 20 and 21 and of the switching valve 22.

In this way, the first executive embodiment of FIG. 1 corresponds to the first flow configuration indicated as a whole by A and corresponding to the ducts marked with a thick line in FIG. 1, in which all the valves are closed and the oil flows from the pan 6 to the active chamber 11 through the delivery duct 16 and the first flow duct 31*a* of the first switch 31, thus closing the slide valve 8 completely and obtaining the maximum delivery of the compressor.

Indeed, with the slide valve 8 completely closed, the whole delivery of air I sucked in the suction chamber 3 is compressed and conveyed to the delivery chamber 4 and then to the system.

Figure 2:
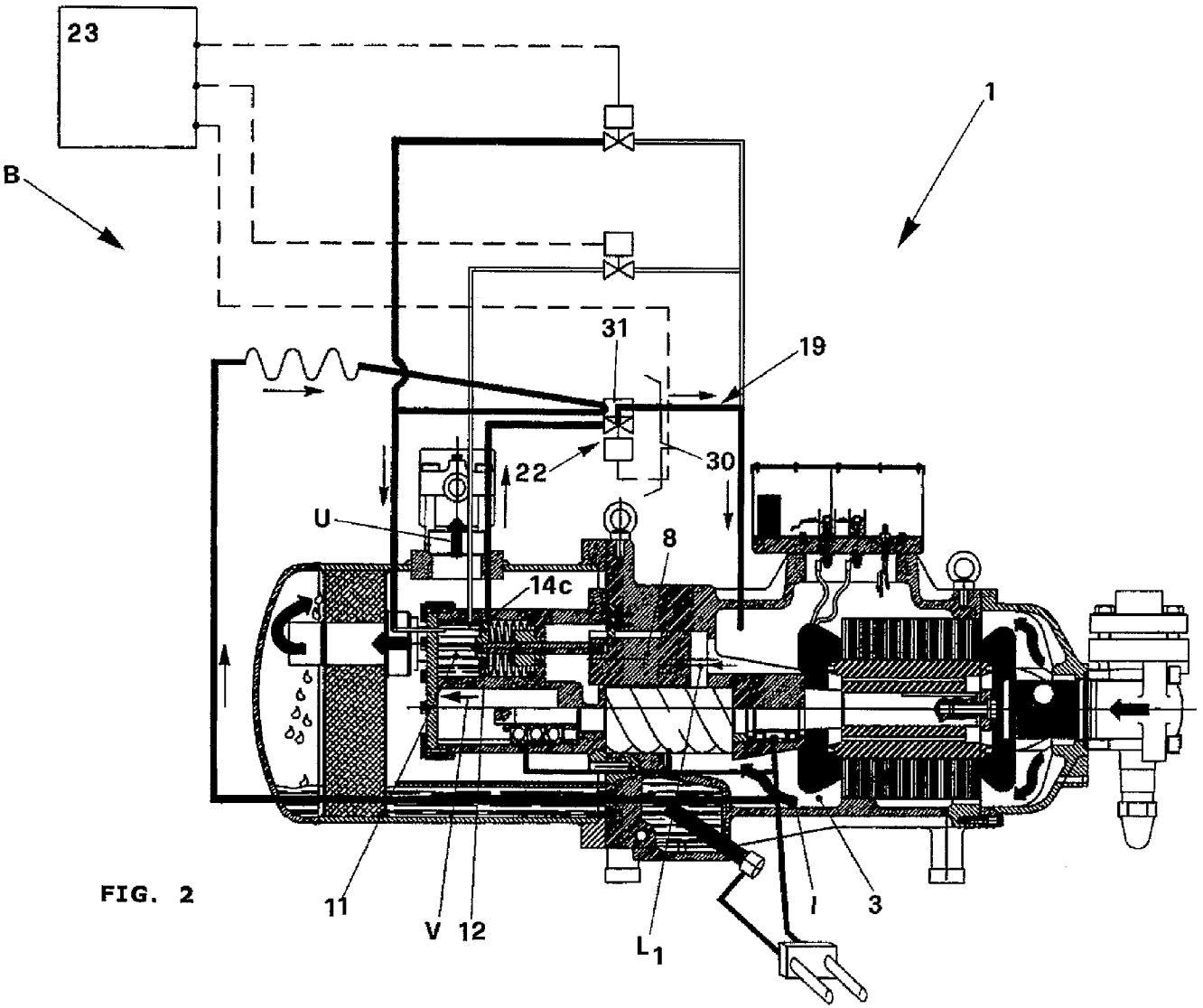

The compressor of the invention, in its first executive embodiment represented in FIG. 1 and equipped with the first switch 31, may also have the second flow configuration indicated as a whole by B, that can be observed in FIG. 2, where the switching valve 22 is opened so that, through the third drain duct 19, the third flow path 14*c* drains a part of the oil contained in the active chamber 11 into the suction chamber 3, making the piston 12 move backward and the slide valve 8 move in the direction indicated by the arrow V.

The backward movement of the slide valve 8 opens the clearance L1 that recirculates a part of the sucked air I in the suction chamber 3 of the compressor.

The degree of reduction in delivery depends on the quantity of oil that is drained from the active chamber 11 and therefore on the position of the third flow path 14*c*.

In the particular executive embodiment described herein, the reduction is such as to achieve a delivery value equal to 75% of the total delivery.

Figure 3:
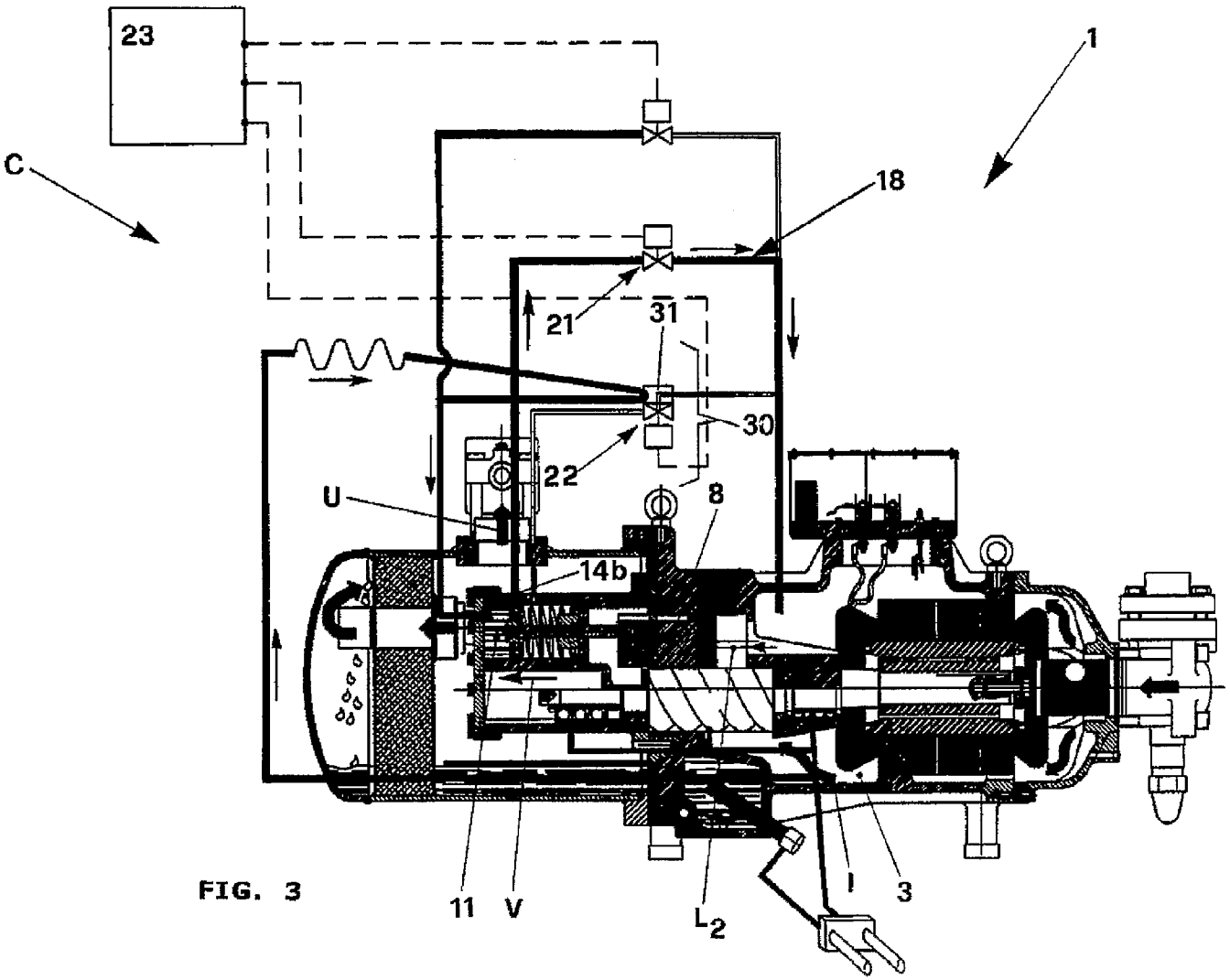

The same first executive embodiment of the compressor may also have the third flow configuration indicated by C and represented in FIG. 3, where the second on-off valve 21 is opened and it is the second flow path 14*b* that, through the second drain duct 18, drains oil from the active chamber 11 into the suction chamber 3 of the compressor.

In this way, a further backward movement of the piston 12 is obtained, always in the same direction indicated by the arrow V, which allows the opening of a larger clearance L2 with increased air recirculation in the suction chamber 3.

Due to the position of the second flow path 14*b*, included between the bottom 15 and the third flow path 14*c*, the active chamber 11 is emptied to a higher extent, in such a way as to achieve, in the executive embodiment described herein, a delivery value equal to 50% of the total value.

Figure 4:
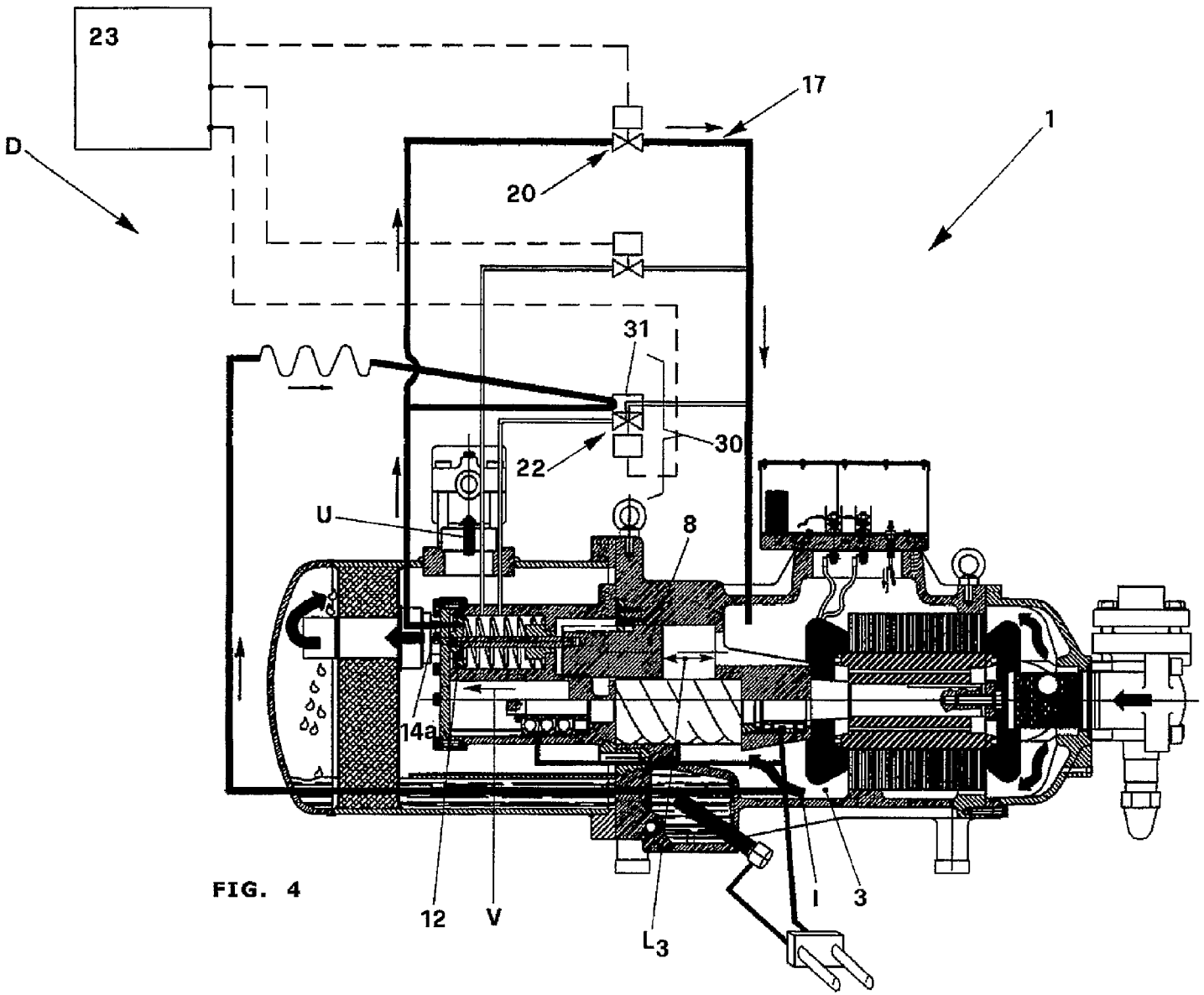

Finally, in the fourth flow configuration indicated by D and represented in FIG. 4, which corresponds to the closing of the first on-off valve 20, the piston 8 is in the most backward position, where the first drain duct 17 completely drains the oil from the active chamber 11 into the suction chamber 3 of the compressor through the first flow path 14*a*.

In this fourth configuration, the clearance L3 is larger than in the previous configurations and makes it possible to achieve a delivery of compressed air equal to 25% of the total delivery.

Figure 5:
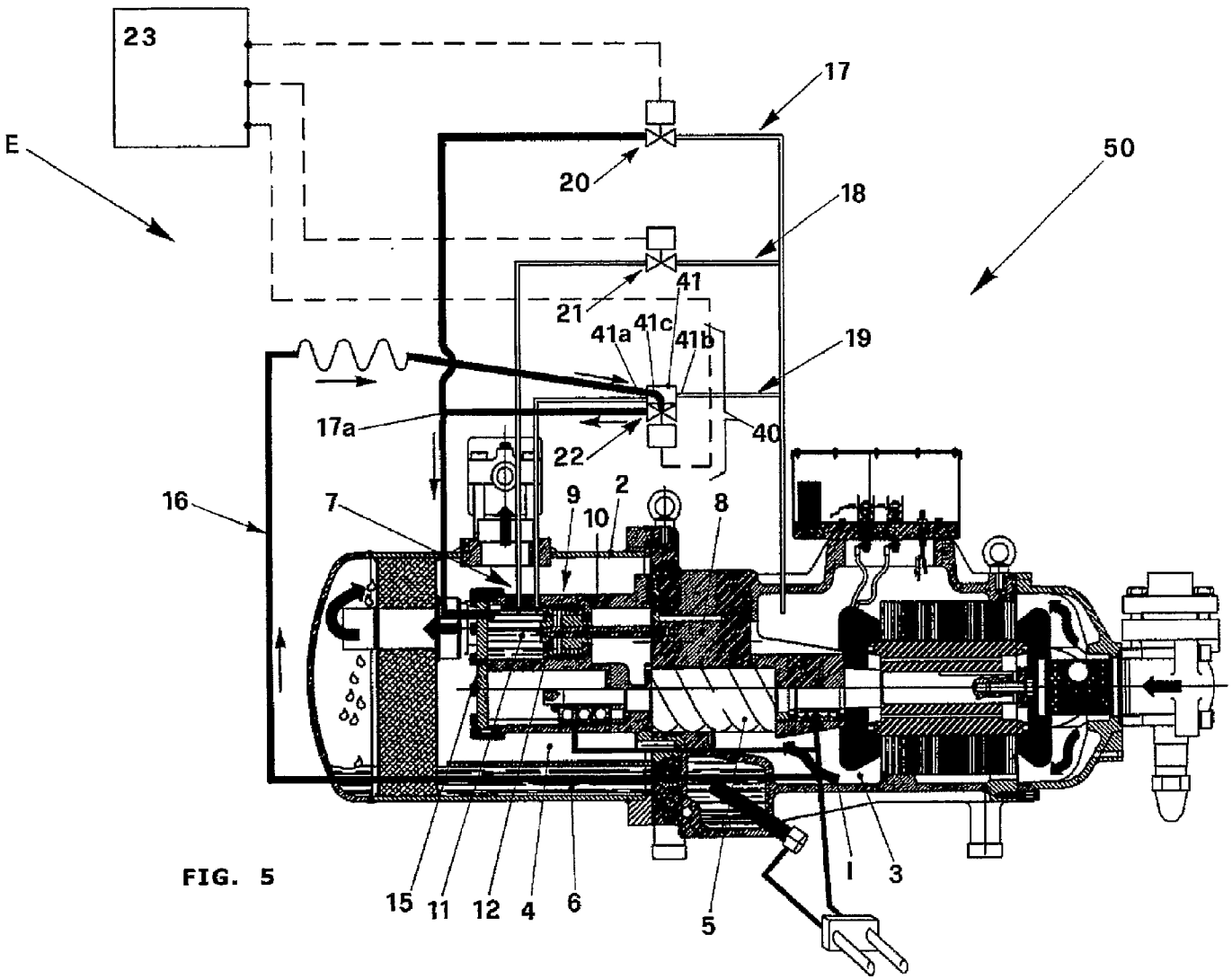

A second executive embodiment of the compressor of the invention is represented in FIG. 5, where it is indicated as a whole by 50 and where it can be observed that it differs from the executive embodiment described above and represented in the FIG*s*. from 1 to 4 due to the fact that the flow switch, indicated as a whole by 40, comprises the same switching solenoid valve 22 previously described and represented, with which a second flow switch 41 is associated.

Said flow switch 41 comprises:

a pair of blind paths 41*a*, 41*b* that intercept the third drain duct 19;

a flow duct 41*c* arranged in series with respect to the switching solenoid valve 22, connecting the delivery duct 16 to the first drain duct 17, in an intermediate position 17*a* between said first on-off solenoid valve 20 and said cylinder 10.

Said second executive embodiment of FIG. 5 corresponds to the fifth flow configuration indicated as a whole by E, in which the piston 12 is in the most advanced position with the slide valve 8 that completely prevents any recycling of air inside the suction chamber 3.

In said fifth configuration, the compressor reaches 100% of the total delivery of compressed fluid.

Figure 6:
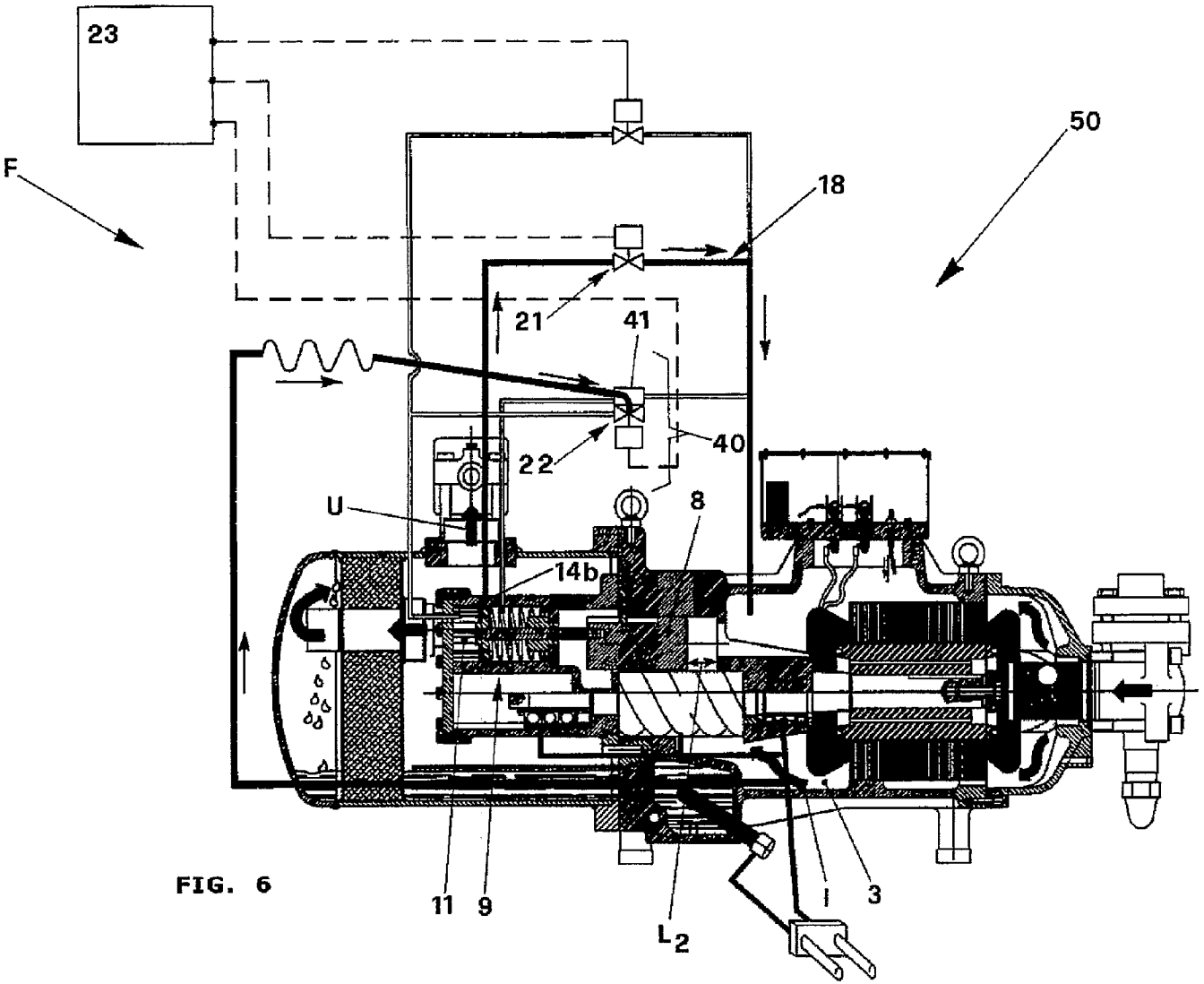

The second executive embodiment of FIG. 5 may have the sixth flow configuration indicated as a whole by F, that can be observed in FIG. 6, in which the second on-off valve 21 is opened in such a way as to place the second flow path 14*a* of the active chamber 11 of the actuator 9 in communication with the suction chamber 3 of the compressor.

In this way, the slide valve 8 opens the same clearance L2 that can be observed in FIG. 3 and the compressor's delivery is equal to 50% of the maximum value.

However, it is important to observe that, in said sixth flow configuration F, the second on-off valve 21 can be opened in steps and for variable lapses of time, starting from the fifth flow configuration E.

In this way, the progressive draining of the active chamber 11 is obtained, which allows to reach, at the delivery outlet U of the compressor, deliveries that vary from 100% to 50%.

Any intermediate delivery value depends on the opening time of the second on-off valve 21 after the active chamber 11 of the cylinder 10 has been completely filled.

Figure 7:
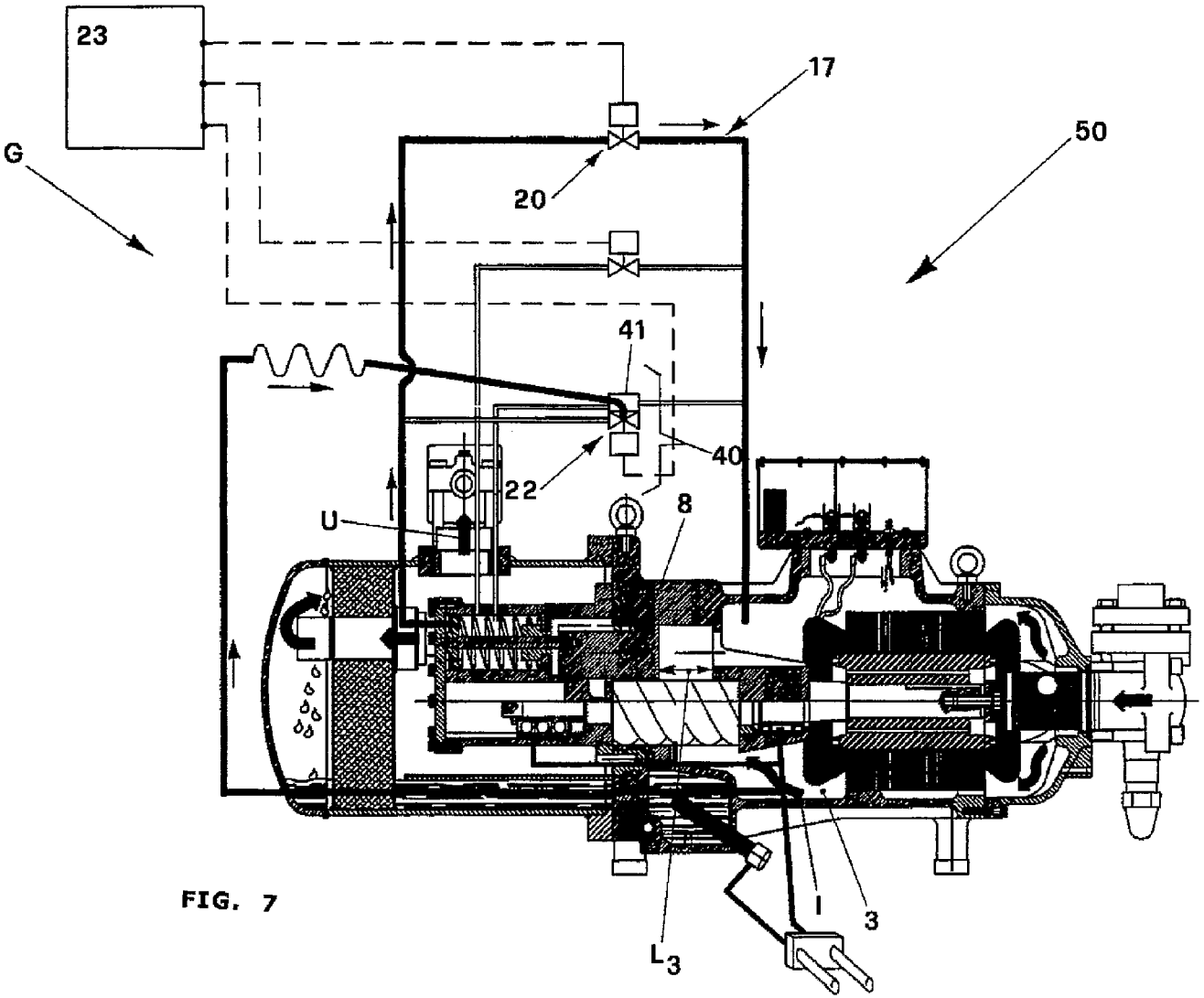

The second executive embodiment of the compressor represented in FIG. 5 also makes it possible to obtain the seventh flow configuration, indicated as a whole by G in FIG. 7, in which the opening of the first on-off valve 20 involves the opening of the clearance L3 of the slide valve 8 and therefore the operation of the compressor at 25% of the maximum delivery value.

Also in this case, by opening the first on-off valve 20 for variable lapses of time starting from the operating condition with 100% of flow shown in FIG. 5 and described above, it is possible to obtain any intermediate delivery value between 100% and 25%.

From a constructional point of view, the first flow switch 31 and the second flow switch 41 are represented in FIGS. 8 and 9 respectively, where it can be observed that they are constituted by metal plates 32, 42, substantially shaped according to a rhomboidal profile and provided with holes 33, 43 for the passage of fastening screws to fix them to the casing of the compressor 2 and to the switching solenoid valve 22.

In particular, a first plate 32 is also provided with the above mentioned first 31*a* and second 31*b* flow ducts, while a second plate 42 is provided with the flow duct 41*c* and with the pair of blind paths 41*a*, 41*b*.

The solenoid valve 22, in both figures, is represented schematically.

It is obvious that the shape of the switches may also differ from the shape illustrated.

It is important to point out that the oil conveying ducts may be carried out in any shape and size and may be installed in any position inside the compressor casing, for example according to the configuration shown in FIGS. 8 and 9, which is only indicative even if corresponding to a favorite executive embodiment.

Upon implementation, changes may be made to the compressor of the invention with respect to the configurations described and illustrated above, and said changes are to be considered protected by the present invention, provided that they fall within the scope of the claims expressed below.

The invention claimed is:

1. Volumetric screw compressor, comprising:

a casing in which it is possible to identify a suction chamber and a delivery chamber, between which a pair of screw rotors is included;

a pan containing oil;

an adjustment unit suited to adjust the delivery of said compressor, comprising:

a slide valve externally cooperating with said rotors;

a fluid-operated actuator constituted by a cylinder in which it is possible to identify an active chamber with a sliding piston connected to said slide valve through a rod;

a plurality of flow paths made in said cylinder in correspondence with said active chamber;

at least one oil delivery duct connected to said pan;

a plurality of oil drain ducts connecting said flow paths of said active chamber to said suction chamber;

on-off solenoid valves inserted in said drain ducts;

at least one control unit for said on-off solenoid valves, wherein said adjustment unit also comprises a flow switching unit that connects said active chamber of said fluid-operated actuator with said pan and with said suction chamber and is constituted by a flow switch removably associated with a switching solenoid valve electrically connected to said control unit, said switching solenoid valve being suited to be associated, alternatively, with flow switches, with separate fluid ducts depending on the open or closed positions of said on-off solenoid valves and said switching solenoid valve and on the position of said slide valve with respect to said rotors, to obtain separate deliveries of compressed fluid.

2. Compressor according to claim 1, wherein it comprises:

a first on-off solenoid valve inserted into a first drain duct that connects a first flow path of said active chamber to said suction chamber;

a second on-off solenoid valve inserted into a second drain duct that connects a second flow path of said active chamber to said suction chamber, said flow switching unit comprising said switching solenoid valve, associated with a first flow switch in which the following is identified:

a first flow duct that connects said delivery duct to said first drain duct in an intermediate position between said first on-off solenoid valve and said cylinder;

a second flow duct arranged in series with respect to said switching solenoid valve and inserted into a third drain duct that connects a third flow path of said active chamber to said suction chamber, in order to obtain deliveries of compressed fluid that vary discretely.

3. Compressor according to claim 2, wherein said on-off solenoid valves and said switching solenoid valve are arranged according to a first configuration in which:

said first on-off solenoid valve is closed;

said second on-off solenoid valve is closed;

said switching solenoid valve is closed, said first configuration being suited to obtain 100% of the delivery of compressed fluid.

4. Compressor according to claim 2, wherein said on-off solenoid valves and said switching solenoid valve are arranged according to a second configuration in which:

said first on-off solenoid valve is closed;

said second on-off solenoid valve is closed;

said switching solenoid valve is open, said second configuration being suited to obtain 75% of the delivery of compressed fluid.

5. Compressor according to claim 2, wherein said on-off solenoid valves and said switching solenoid valve are arranged according to a third configuration in which:

said first on-off solenoid valve is closed;

said second on-off solenoid valve is open;

said switching solenoid valve is closed, said third configuration being suited to obtain 50% of the delivery of compressed fluid.

6. Compressor according to claim 2, wherein said on-off solenoid valves and said switching solenoid valve are arranged according to a fourth configuration in which:

said first on-off solenoid valve is open;

said second on-off solenoid valve is closed;

said switching solenoid valve is closed, said fourth configuration being suited to obtain 25% of the delivery of compressed fluid.

7. Compressor according to claim 2, wherein said first, said second and said third flow path of said active chamber are positioned at different distances with respect to the bottom of said cylinder.

8. Compressor according to claim 7, wherein said first flow path is made in the bottom of said cylinder and said second and third flow paths are made in the liner of said cylinder.

9. Compressor according to claim 8, wherein said second flow path is made in an intermediate position between said bottom and said third flow path.

10. Compressor according to claim 8, wherein said second and said third flow paths are aligned.

11. Compressor according to claim 2, wherein each one of said flow switches is constituted by shaped metal plates, each of said plates being provided with holes for the passage of fastening screws to fix them to said switching solenoid valve and to said casing.

12. Compressor according to claim 11, wherein said shaped metal plates comprise a first plate provided with a first and a second flow duct.

13. Compressor according to claim 11, wherein said shaped metal plates comprise a second plate provided with a flow duct and with a pair of blind paths.

14. Compressor according to claim 1, wherein it comprises:

a first on-off solenoid valve inserted into a first drain duct that connects a first flow path of said active chamber to said suction chamber;

a second on-off solenoid valve inserted into a second drain duct that connects a second flow path of said active chamber to said suction chamber, said flow switch comprising said switching solenoid valve associated with a second flow switch in which the following is identified:

a pair of blind paths that intercept a third drain duct that connects a third flow path of said active chamber to said suction chamber;

a flow duct arranged in series with respect to said switching solenoid valve to connect said delivery duct to said first drain duct in an intermediate position between said first on-off solenoid valve and said cylinder, in order to obtain deliveries of compressed fluid that vary continuously.

15. Compressor according to claim 14, wherein said on-off solenoid valves and said switching solenoid valve are arranged according to a fifth configuration in which:

said first on-off solenoid valve is closed;

said second on-off solenoid valve is closed;

said switching solenoid valve is open, said fifth configuration being suited to obtain 100% of the delivery of compressed fluid.

16. Compressor according to claim 15, wherein said on-off solenoid valves and said switching solenoid valve are arranged according to a sixth configuration in which:

said first on-off solenoid valve is closed;

said second on-off solenoid valve is opened for a variable lapse of time and then closed again;

said switching solenoid valve is closed, said sixth configuration being suited to obtain a value of the delivery of compressed fluid included between 100% and 50%, depending on the opening time of said second on-off solenoid valve.

17. Compressor according to claim 15, wherein said on-off solenoid valves and said switching solenoid valve are arranged according to a seventh configuration in which:

said first on-off solenoid valve is open;

said second on-off solenoid valve is closed;

said switching solenoid valve is opened for a variable lapse of time and then closed again;

said seventh configuration being suited to obtain a value of the delivery of compressed fluid included between 100% and 25%, depending on the opening time of said switching solenoid valve.

18. Compressor according to claim 14, wherein said first, said second and said third flow path of said active chamber are positioned at different distances with respect to the bottom of said cylinder.

19. Compressor according to claim 14, wherein each one of said flow switches is constituted by shaped metal plates, each of said plates being provided with holes for the passage of fastening screws to fix them to said switching solenoid valve and to said casing.

20. Compressor according to claim 1, wherein said control unit is electrically connected to each one of said on-off solenoid valves and said switching solenoid valve and comprises electric/electronic means for opening/closing said on-off solenoid valves and said switching solenoid valve.

* * * * *